US008490825B2

(12) United States Patent
Reed et al.

(10) Patent No.: US 8,490,825 B2
(45) Date of Patent: Jul. 23, 2013

(54) CAN LID CLOSURE AND METHOD OF JOINING A CAN LID CLOSURE TO A CAN BODY

(75) Inventors: James Reed, Ballwyn, MO (US); Christopher G. Neiner, Newton, PA (US)

(73) Assignee: Metal Container Corporation

( * ) Notice: Subject to any disclaimer, the term of this patent is extended or adjusted under 35 U.S.C. 154(b) by 1707 days.

(21) Appl. No.: 11/188,563

(22) Filed: Jul. 25, 2005

(65) Prior Publication Data

US 2005/0252922 A1 Nov. 17, 2005

Related U.S. Application Data

(63) Continuation-in-part of application No. 10/752,928, filed on Jan. 7, 2004, now abandoned, which is a continuation of application No. 10/153,364, filed on May 22, 2002, now Pat. No. 6,702,142, which is a continuation of application No. 09/456,345, filed on Dec. 8, 1999, now Pat. No. 6,499,622.

(51) Int. Cl.
*B21D 51/44* (2006.01)

(52) U.S. Cl.
USPC ..... 220/623; 220/619

(58) Field of Classification Search
CPC ..... B21D 51/44
USPC ..... 220/623, 619
See application file for complete search history.

(56) References Cited

U.S. PATENT DOCUMENTS

| | | | |
|---|---|---|---|
| 3,749,277 | A | 7/1973 | Kinney |
| 3,774,801 | A | 11/1973 | Gedde |
| 4,448,322 | A | 5/1984 | Kraska |
| 4,577,774 | A | 3/1986 | Nguyen |
| 4,796,772 | A | 1/1989 | Nguyen |
| 4,832,223 | A | 5/1989 | Kalenak et al. |
| RE33,217 | E | 5/1990 | Nguyen |
| 4,991,735 | A | 2/1991 | Biondich |
| 5,149,238 | A | 9/1992 | McEldowney et al. |
| 5,253,781 | A | 10/1993 | Van Melle et al. |
| 5,829,623 | A | 11/1998 | Otsuka et al. |
| 5,975,344 | A | 11/1999 | Stevens |
| 6,419,110 | B1 | 7/2002 | Stodd |
| 6,460,723 | B2 | 10/2002 | Nguyen et al. |
| 6,516,968 | B2 | 2/2003 | Stodd |
| 6,748,789 | B2 | 6/2004 | Turner et al. |

(Continued)

FOREIGN PATENT DOCUMENTS

| | | | |
|---|---|---|---|
| DE | 29906170 | U1 | 10/1999 |
| EP | 0103074 | A2 | 3/1984 |

(Continued)

*Primary Examiner* — Stephen Castellano
(74) *Attorney, Agent, or Firm* — Gardere Wynne Sewell LLP

(57) ABSTRACT

Over the years there have been numerous attempts to improve the can lid oftentimes found on aluminum beverage can lids. The aims have traditionally been to reduce costs and improve performance. These aims have been accomplished through a variety of means, such as creating different formations within the can lid to reduce the amount of metal used while maintaining performance levels. Here, step portions are utilized between the annular countersink and the center panel of the can lid that cause a curvature of the center panel or to simply provide an angled inside wall. These formations, thus, reduce the amount of metal used while maintaining quality and yielding the desired performance.

29 Claims, 7 Drawing Sheets

U.S. PATENT DOCUMENTS

| | | | | |
|---|---|---|---|---|
| 2004/0011803 | A1 | 1/2004 | D'Amato | |
| 2004/0211780 | A1 * | 10/2004 | Turner et al. | 220/270 |
| 2005/0029269 | A1 | 2/2005 | Stodd et al. | |

FOREIGN PATENT DOCUMENTS

| | | | |
|---|---|---|---|
| EP | 0497346 | A | 8/1992 |
| GB | 1602309 | A | 11/1981 |
| GB | 2315478 | A | 2/1998 |
| JP | 49-096887 | A | 9/1974 |
| JP | 50-144580 | A | 11/1975 |
| JP | 54-074184 | A | 6/1979 |
| JP | 55-122945 | U | 2/1980 |
| JP | 56-053835 | A | 5/1981 |
| JP | 56-053836 | A | 5/1981 |
| JP | 57-044435 | A | 3/1982 |
| JP | 57-094436 | A | 6/1982 |
| JP | 58-035028 | A | 3/1983 |
| JP | 58-035029 | A | 3/1983 |
| JP | 1983-35028 | | 3/1983 |
| JP | 58-70329 | | 5/1983 |
| JP | 59-144535 | A | 8/1984 |
| JP | 61-023533 | A | 2/1986 |
| JP | 63-125152 | A | 5/1988 |
| JP | 01-170538 | A | 7/1989 |
| JP | 01-289526 | A | 11/1989 |
| JP | 02-092426 | A | 4/1990 |
| JP | 02-131931 | U | 11/1990 |
| JP | 03-032835 | A | 2/1991 |
| JP | 03-275443 | | 6/1991 |
| JP | 04-55028 | | 2/1992 |
| JP | 07-171645 | A | 7/1995 |
| JP | 08-168837 | A | 7/1996 |
| JP | 08-192840 | A | 7/1996 |
| JP | 2000-109068 | A | 4/2000 |
| JP | 2002-178072 | A | 6/2002 |
| JP | 2002-308263 | A | 10/2002 |
| JP | 2003-136168 | A | 5/2003 |
| JP | 2003-205940 | | 7/2003 |
| WO | WO 89/10216 | | 11/1989 |
| WO | WO 93/17864 | | 9/1993 |
| WO | 96-37414 | | 11/1996 |
| WO | 98-34743 | | 8/1998 |
| WO | WO 00/12243 | | 3/2000 |

* cited by examiner

CAN LID CLOSURE AND METHOD OF JOINING A CAN LID CLOSURE TO A CAN BODY

CROSS-REFERENCE TO RELATED APPLICATION

This application is a continuation-in-part of U.S. patent application Ser. No. 10/752,928 entitled "CAN LID CLOSURE AND METHOD OF JOINING A CAN LID CLOSURE TO A CAN BODY," filed on Jan. 7, 2004, now abandoned, which is a continuation of U.S. patent application Ser. No. 10/153,364, now U.S. Pat. No. 6,702,142, entitled "CAN LID CLOSURE AND METHOD OF JOINING A CAN LID CLOSURE TO A CAN BODY," filed on May 22, 2002 which was a continuation of U.S. patent application Ser. No. 09/456,345, now U.S. Pat. No. 6,499,622, entitled "CAN LID CLOSURE AND METHOD OF JOINING A CAN LID CLOSURE TO A CAN BODY," filed on Dec. 8, 1999 for inventor/applicant Christopher G. Neiner, wherein each related application is incorporated by reference herein for all purposes.

TECHNICAL FIELD

The present invention relates generally to containers, particularly to metallic beverage cans, and more particularly to metallic beverage can end closures adapted for interconnection to metallic beverage cans.

BACKGROUND OF THE INVENTION

Aluminum cans are used primarily as containers for retail sale of beverages, typically in individual portions. Annual sales of such cans are in the billions and consequently, over the years, their design has been refined to reduce cost and improve performance. Typically, the can is formed from a single piece of metal, which is drawn and ironed, and has an open end. The can is filled with a beverage by means of the open end, and a can lid is then positioned over the open end and sealed to the can to contain the beverage therein and prevent contamination of the beverage. In some arrangements, the can has two open ends to which can lids are sealed.

Cost reductions in can production may be realized in material savings, scrap reduction and improved production rates. Performance improvements may be functional in nature, such as better sealing and higher ultimate pressure capacity. Such improvements can allow the use of thinner sheet metal, which leads directly to material cost reductions. Performance improvements may also be ergonomic in nature, such as a can end configured to allow for easier pull tab access or better pouring characteristics.

Beverage cans and ends, which are typically made from relatively thin sheet metal, must be capable of withstanding internal pressures approaching 100 psi (with 90 psi being an industry recognized requirement) without the can failing, such as by leaking or bulging. Additionally, these components must meet other specifications and requirements. For instance, the upper surface of the can lids must be configured to nest with the lower surface of the can bottoms so that the cans can be easily stacked one on top of the other. It is also desirable to have the can lids themselves nest with each other in a stacked arrangement for handling and shipping purposes prior to attaching the can lid to the can body. The ability to satisfy these functional requirements with the use of ever less material continues to be a goal for can manufacturers.

There have been various beverage can lids developed having various unique geometric configurations in an effort to reduce material costs while still making can lids that meet the various industry requirements. For example, U.S. Pat. No. 6,065,634 describes a can lid design for reduced metal usage having a peripheral curl portion, an outwardly concave annular reinforcing bead, a frustoconical chuckwall inclined at an angle of between 40° and 60° with respect to an axis perpendicular to the center panel connecting the peripheral curl and the reinforcing bead, and a center panel connected to the interior portion of the annual reinforcing bead. It has been found that the can lid of U.S. Pat. No. 6,065,634 is susceptible to increased metal deformation during seaming and resulting failure at lower pressures.

Other patents disclose can lids having modifications of the chuckwall and/or annular countersink that are designed to improve the strength of the can lids while saving material costs. Examples of these include U.S. Pat. Nos. 6,499,622, 6,561,004, and 6,702,142 to Neiner which are incorporated herein in their entirety by reference. Another pending application which attempts to make further improvements to the can lid by means of improving the countersink region is U.S. Patent Application Publication No. 20030173367 to Nguyen, et. al.

There have also been a variety of other applications that have employed structures between the annular countersink and the center panel. Examples of such designs include U.S. Pat. Nos. 5,149,238, 4,832,223, 4,796,772, 4,991,735, and 4,577,774, Reissue Pat. No. RE33,217, European Patent Application No. EP0103074, German Patent No. DE29906170, and Japanese Patent Application No. 2002-178072.

One example of a prior art can lid configuration that employs a structure between the annular countersink and the center panel is depicted in FIG. 1. Referring to FIG. 1 of the drawings, the reference numeral 100 generally designates a can lid having a step portion between the annular countersink and the center panel. The can lid 100 comprises a peripheral curl portion 108, a chuckwall 114, an annular countersink 112, a center panel 110, a first step portion 116, a transitional portion 118, a second step portion 120, and a third step portion 122. It should also be noted that the term "negative concavity" refers to being concave when viewed toward an underside of the can lid 100, and "positive concavity" refers to being concave when viewed toward a topside of the can lid 100.

Can lid 100 is generally circular in shape having the center panel 110, also with a generally circular shape, at the center. Along the outer circumferential edge of the can lid 100 is the peripheral curl 108 portion, which is employed to form a double seam with a can body (not shown). Immediately adjacent to the peripheral curl portion 108 is the chuckwall 114 that extends radially inward toward the center of the can lid 100 and transitions downward to a lower depth than the peripheral curl portion 108. Annular countersink 112 is then formed adjacent to the chuckwall 114 having a radius of curvature $r_{a1}$ with positive concavity, where the lowest depth of the can lid 100 is located at the apex of the annular countersink 112.

As the annular countersink 112 transitions from the apex upward, as well as radially inward, a transitional portion 118 is employed. First step portion 116 with a radius of curvature $r_{a2}$ with a negative concavity is formed between the annular countersink 112 and the step portion 118. Second step portion 120, having a radius of curvature $r_{a3}$ and positive concavity, and third step portion 122, having a radius of curvature $r_{a4}$ and negative concavity are utilized to smoothly transition between the depth of the step portion 118 and the center panel 110.

Another example of a prior art can lid configuration that employs a structure between the annular countersink and the center panel is depicted in FIG. 2. Referring to FIG. 2 of the drawings, the reference numeral 200 generally designates a can lid having a transitional portion and a raised bead between the annular countersink and the center panel. The can lid 200 comprises a peripheral curl portion 108, a chuckwall 114, an annular countersink 112, a center panel 110, a first step portion 216, a transitional portion 214, a second step portion 220, a raised bead 222, and a third step portion 224.

Can lid 200 is generally circular in shape having the center panel 110, also with a generally circular shape, at the center. Along the outer circumferential edge of the can lid 200 is the peripheral curl 108 portion, which is employed to form a double seam with a can body (not shown). Immediately adjacent to the peripheral curl portion 108 is the chuckwall 114 that extends radially inward toward the center of the can lid 200 and transitions to a lower depth than the peripheral curl portion 108. Annular countersink 112 is then formed adjacent to the chuckwall 114 having a relatively flat bottom parallel to the center panel 110, where the lowest depth of the can lid 200 is located at the bottom portion of the annular countersink 112.

As the annular countersink 112 transitions from the apex upward, as well as radially inward, a transitional portion 214 is employed. First step portion 216 with a radius of curvature $r_{b1}$ with a negative concavity is formed between the annular countersink 112 and the transitional portion 214. Transitional portion 214 is at a depth that is approximately equal to center panel 110. Second step portion 220, having a radius of curvature $r_{b2}$ and positive concavity, is located between the transitional portion 214 and the raised bead 222, which has a radius of curvature $r_{b3}$ with negative concavity and a height greater than the center panel 110. Third step portion 224, having a radius of curvature $r_{b4}$ and positive concavity, is utilized to smoothly transition from the raised bead 222 to the center panel 110.

Yet another example of a prior art can lid configuration that employs a structure between the annular countersink and the center panel is depicted in FIG. 3. Referring to FIG. 3 of the drawings, the reference numeral 300 generally designates a can lid having a step portion with a bevel between the annular countersink and the center panel. The can lid 300 comprises a peripheral curl portion 108, a chuckwall 114, an annular countersink 112, a center panel 110, and a step portion 316.

Can lid 300 is generally circular in shape having the center panel 110, also with a generally circular shape, at the center. Along the outer circumferential edge of the can lid 300 is the peripheral curl 108 portion, which is employed to form a double seam with a can body (not shown). Immediately adjacent to the peripheral curl portion 108 is the chuckwall 114 that extends radially inward toward the center of the can lid 300 and transitions to a lower depth than the peripheral curl portion 108. Annular countersink 112 is then formed adjacent to the chuckwall 114 having a radius of curvature $r_{c1}$ with positive concavity relative to the top of the can lid 100, where the lowest depth of the can lid 300 is located at the apex of the annular countersink 112.

As the annular countersink 112 transitions from the apex upward, as well as radially inward, step portion 316 with a radius of curvature $r_{c2}$ with a negative concavity is formed between the annular countersink 112 and the center panel 110. Additionally, on the outer surface of the step portion 316, a beveled edge 318 is utilized.

A last example of a prior art can lid configuration that employs a structure between the annular countersink and the center panel is depicted in FIG. 4. Referring to FIG. 4 of the drawings, the reference numeral 400 generally designates a can lid having a raised bead between the annular countersink and the center panel. The can lid 400 comprises a peripheral curl portion 108, a chuckwall 114, an annular countersink 112, a center panel 110, a raised bead 416, and a step portion 418.

Can lid 400 is generally circular in shape having the center panel 110, also with a generally circular shape, at the center. Along the outer circumferential edge of the can lid 400 is the peripheral curl 108 portion, which is employed to form a double seam with a can body (not shown). Immediately adjacent to the peripheral curl portion 108 is the chuckwall 114 that extends radially inward toward the center of the can lid 400 and transitions to a lower depth than the peripheral curl portion 108. Annular countersink 112 is then formed adjacent to the chuckwall 114 having a radius of curvature $r_{d1}$ with positive concavity relative to the top of the can lid 400, where the lowest depth of the can lid 400 is located at the apex of the annular countersink 112.

As the annular countersink 112 transitions from the apex upward, as well as radially inward, raised bead 416 is employed. Raised bead 416 has a radius of curvature $r_{d2}$ with a negative concavity where the apex of the raised bead 416 is at a height greater than the center panel 110. Transitional portion 418, having a radius of curvature $r_{d3}$ and positive concavity, couples the raised bead 416 to the center panel 110.

Each of these varying designs poses a particular subset of problems, such as difficulty in manufacturing, inability to withstand internal pressures, cost, and so forth. Therefore, there is a need for a method and/or apparatus that at least addresses some of the problems associated with conventional or prior art can lids and that provides better can lids that can save material costs while still withstanding internal pressures.

SUMMARY OF THE INVENTION

The present invention provides a lid for a can body. Specifically, the lid comprises a center panel having a central axis that is perpendicular to a diameter of an outer rim of the lid, where the center panel has a height that varies as a function of radial distance relative from the central axis. Extending radially outward from the center panel is a first step portion having negative concavity and having a radius of curvature less than about 0.015 inches. A second step portion, then, extends radially outward from the first step portion having a positive concavity and having a radius of curvature less than about 0.015 inches. From there, an angled inner wall extends radially outward from the second step portion having an angle from a line extending through each end of the angled inner wall relative to the central axis of less than about 50°. Additionally, an annular countersink portion extends radially outward from the center panel, and a chuckwall extends from the annular countersink. Finally, a peripheral curl portion extends radially outward from the chuckwall.

In another embodiment of the present invention, the chuckwall further comprises a number of other features. In particular, an arcuate portion extends radially outward from the annular countersink and is characterized by a radius of less than about 0.5 inches with a center point below the surface of the lid, wherein a line passing through the ends of the arcuate portion is at an angle with respect to the central axis of the center panel of from about 20° to about 80°. Additionally, a third step portion extending radially outward from the arcuate portion and characterized by a radius of at least 0.010 inches, with a center point above the surface of the lid is formed. A first transitional portion also extends radially outward from the step portion and being generally frustoconical and inclined at an angle with respect to the central axis of at least about 15° and less than about 25°. A second transitional portion extends radially outward from the first transitional portion and is characterized by a radius of at least 0.020 inches with a center point below the surface of the lid.

In yet another embodiment of the present invention, a line passing through the ends of the angled inner wall is at an angle with respect to the central axis of the center panel from about 25° to about 35° in one embodiment and is about 30° in another embodiment.

In another embodiment of the present invention, the first step portion has a radius of curvature that is about 0.010 inches.

In another embodiment of the present invention, the second step portion has a radius of curvature that is about 0.010 inches.

In yet another embodiment of the present invention, the center panel is substantially domed or arcuate.

In another embodiment, the diameter of the center panel is from about 1.4 to about 2.0 inches, and there is an annular countersink height of from about 0.030 to about 0.115 inches.

The present invention also provides a method of forming a double seam joining a can body to a can lid, the can lid having a center panel having a central axis that is perpendicular to a diameter of an outer rim of the lid, wherein the center panel has a variable height relative to a radial distance relative to the central axis, a first step portion extending radially outward from the center panel, a second step portion extending radially outward from the first step portion, an angled inner wall extending radially outward from the second step portion having an angle from a line extending through each end of the angled inner wall relative to the central axis of less than about 50°, an annular countersink portion extending radially outward from the center panel, a chuckwall having an arcuate step portion and a transitional portion, wherein the chuckwall extends radially outward from the annular countersink, a peripheral curl portion extending radially outward from the chuckwall, and the can body having a can body flange. The method includes or comprises supporting the can body on a base plate and positioning the can lid on the can body with the transitional portion resting on the can body flange. Once positioned, a chuck is provided to engage the can lid with the chuck so as to contact the annular countersink while leaving the arcuate step portion undeformed. The can and lid assembly are then rotated using the chuck to roll the peripheral curl and can body flange together to form an intermediate peripheral seam and to compress the intermediate peripheral seam against the chuck to form a double seam.

In an alternative embodiment of the present invention, another lid for a can body is provided. With this lid, there is a center panel having a central axis that is perpendicular to a diameter of an outer rim of the lid. Extending radially outward from the center panel portion is an angled inner wall having an angle from a line extending through each end of the angled inner wall relative to the central axis of less than about 50°. Then, extending radially outward from the angled inner wall is an annular countersink portion. A chuckwall is also formed, which extends radially outward from the annular countersink. Extending radially outward therefrom is a peripheral curl portion.

Some other additional embodiments of the present invention are also provided, namely, step portions at each end and a first step portion extending radially outward from the center panel having negative concavity and having a radius of curvature less than about 0.015 inches with a second step portion extending radially outward from the angled inner wall having a negative concavity and having a radius of curvature less than about 0.015 inches.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings are incorporated into and form a part of the specification to assist in explaining the present invention. The drawings are intended for illustrative purposes only and are not intended as exact representations of the embodiments of the present invention. The drawings further illustrate preferred examples of how the invention can be made and used and are not to be construed as limiting the invention to only those examples illustrated and described. The various advantages and features of the present invention will be apparent from a consideration of the drawings in which.

DETAILED DESCRIPTION

Figure 1:
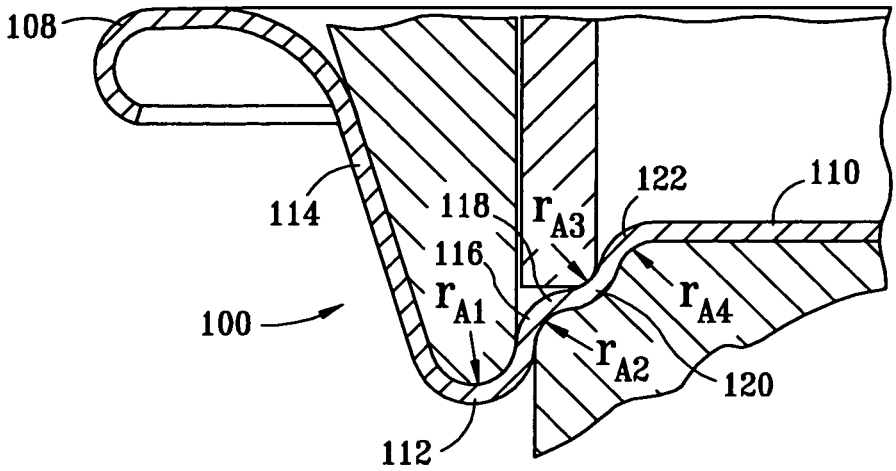
FIG. 1 PRIOR ART
FIG. 1 depicts an elevational cross-sectional view of a portion of a conventional or prior art can lid having a step portion between the annular countersink and the center panel.
Figure 2:
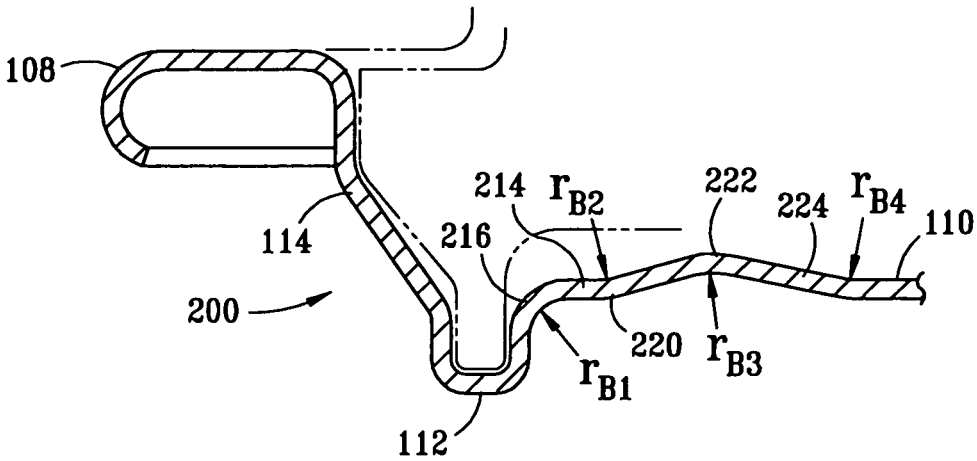
FIG. 2 PRIOR ART
FIG. 2 depicts an elevational cross-sectional view of a portion of a conventional or prior art can lid having a step portion and a raised bead between the annular countersink and the center panel.
Figure 3:
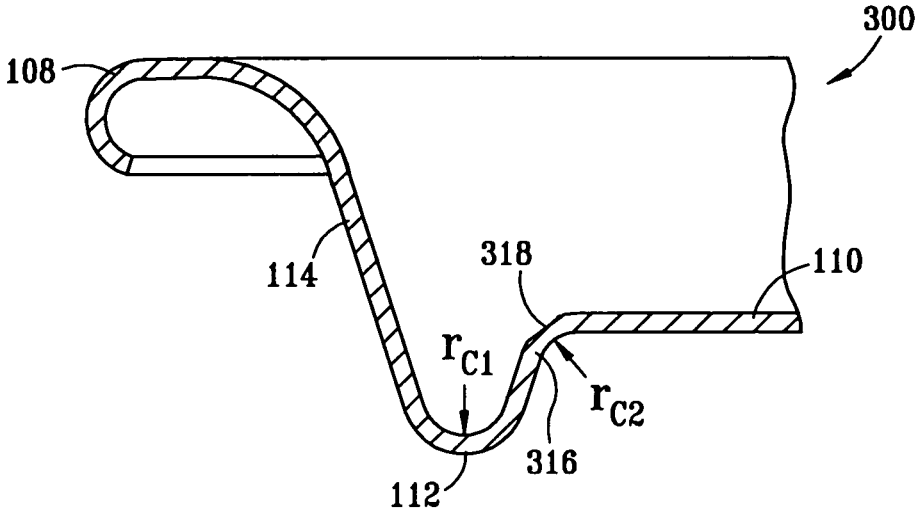
FIG. 3 PRIOR ART
FIG. 3 depicts an elevational cross-sectional view of a portion of a conventional or prior art can lid having a beveled edge in the step portion between the annular countersink and the center panel.
Figure 4:
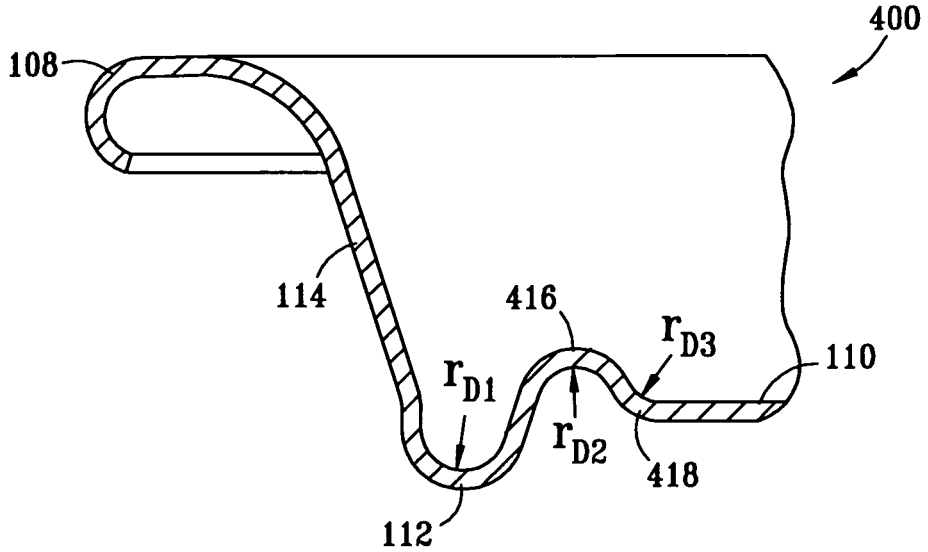
FIG. 4 PRIOR ART
FIG. 4 depicts an elevational cross-sectional view of a portion of a conventional or prior art can lid having a raised bead between the annular countersink and the center panel.

The present invention is described in the following text by reference to drawings of examples of how the invention can be made and used. The drawings are for illustrative purposes only and are not necessarily exact scale representations of the embodiments of the present invention. In these drawings, the same reference characters are used throughout the views to indicate like or corresponding parts. The embodiments shown and described herein are exemplary. Many details are well known in the art, and as such are neither shown nor described. It is not claimed that all of the details, parts, elements, or steps described and shown were invented herein. Even though numerous characteristics and advantages of the present invention have been described in the drawings and accompanying text, the description is illustrative only, and changes may be made, especially in matters of arrangement, shape and size of the parts, within the principles of the invention to the full extent indicated by the broad general meaning of the terms used in the claims. The dimensions provided in the description of the lids are tooling dimensions and the actual dimensions of can lids manufactured in accordance with the present invention may be slightly different from the tooling dimensions. The words "extend radially outward," "extend radially inward," "extend radially downward," and "extend radially upward" as used in this document mean that a part or portion extends in the noted direction from another part referred to. It does not, however, necessarily mean that the parts are joined or connected to each other; there could be other parts or portions between the two described portions that are neither shown nor described. When the words "joined" or "connected" are used in this document, they have their normal meanings. The word "up," as used in this document, is used in reference to a can lid as it would appear when placed on a flat surface with the tab on the face away from the top of the flat surface, such as a can lid would appear when looking down onto the top of a beverage can. Moreover, the term "negative concavity" refers to being concave when viewed toward an underside of a can lid, and "positive concavity" refers to being concave when viewed toward a topside of a can lid.

Figure 5A:
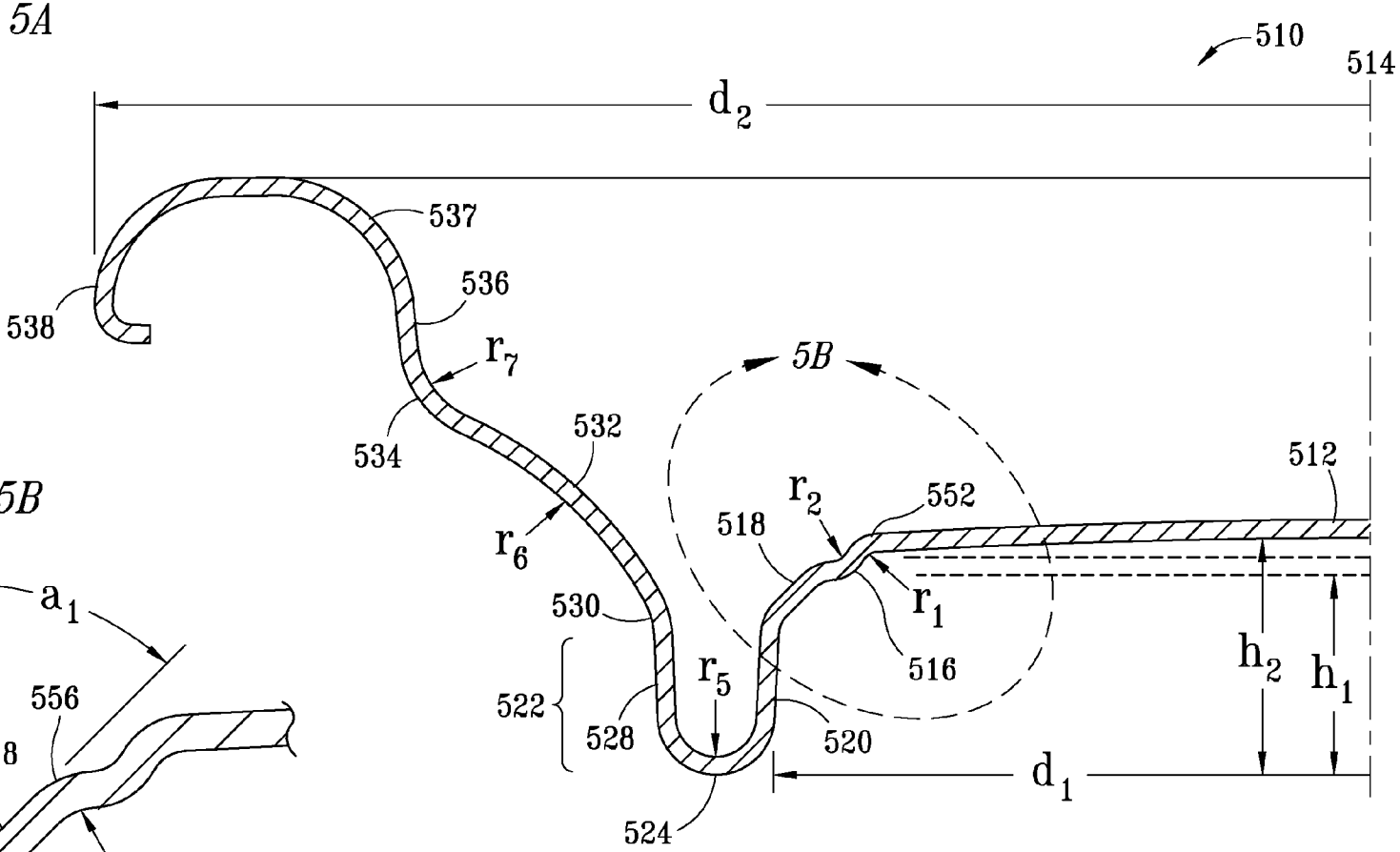
FIGS. 5A and 5B depict elevational cross-sectional views of a portion of a can lid constructed in accordance with the invention.
Figure 5B:
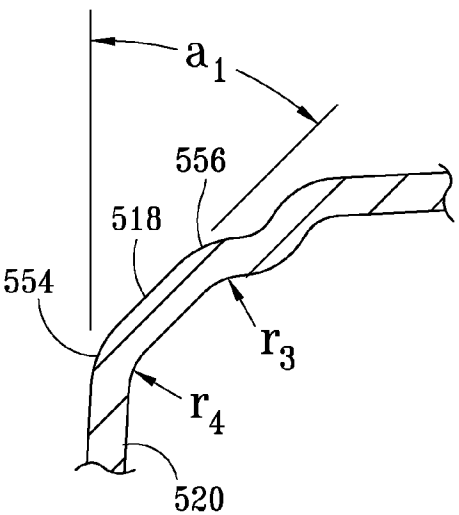

FIGS. 5A and 5B are cross-sectional views of a portion of a can lid 510, illustrative of the currently preferred embodiment of the present invention. Can lid 510 comprises a center panel 512, a step portion 552, a step portion 516, an angled inside wall 518, an annular countersink 522, an arcuate portion or arcuate chuckwall 532, a step portion 534, a transitional portion 536, a step portion 537, and a peripheral curl portion 538. Additionally, annular countersink 522 comprises an exterior wall 528, a curved bottom portion 524, and an interior wall 520.

Can lid 510 is preferably made from sheet metal, although other materials can also be used. Typically, an aluminum alloy is used, such as aluminum alloy 5182. The sheet metal typically has a thickness from about 0.007 to about 0.010 inches. The sheet metal may be coated with a coating (not shown) on at least one side. This coating is usually provided on that side of the sheet metal that will form the interior of the can. Those skilled in the art will be well acquainted with the methods of forming can lids as described herein.

The can lid 510 has a center panel 512. The center panel 512 is generally circular in shape but may be intentionally noncircular. The center panel 512 is generally delimited by the interior wall 520 and has a diameter from about 1.3 to about 2.0 inches. A portion of the diameter of center panel 512 is indicated by $d_1$. Although the center panel 512 is shown as being generally peaked or domed, it may also have a generally flat configuration as well, and is not necessarily limited to the peaked or domed configuration shown. The center panel 512 has a central axis 514. The outer rim, or peripheral curl portion 538, of can lid 510 has a diameter, a portion of which is indicated by distance $d_2$, which may be from about 2.25 to 2.50 inches, with a preferred diameter of 2.34 inches. The diameter of center panel 512 is preferably less than 80% of the diameter of the outer rim 538.

The center panel 512 has a step 552 with a radius of curvature $r_1$, with a negative concavity that allows transition to a lower depth, that is, from about 0.0060 to about 0.015 inches. Step portion 516, then, is adjacent to step portion 552, having a radius of curvature $r_2$, with a positive concavity that allows transition to a lower depth, that is, from about 0.010 to about 0.015 inches.

Descending from the bottom of the step portions 516 and 552 is an angled inside wall 518, shown in greater detail in FIG. 5B. Specifically, one end of step portion 516 is attached to a step portion 556 of angled inside wall 518, having a radius of curvature $r_3$ with negative concavity, and interior wall 520 of annular countersink 522 is attached to a step portion 554 of angled inside wall 518, having a radius of curvature $r_4$ with negative concavity. Angled interior wall 518 is preferably a straight or flat angled interior wall 518; however, it is possible to have an arcuate wall with a negative or positive concavity. In either case, however, a straight line can be drawn between the step portion 556 and the step portion 554 (or the ends of wall 518) that forms an acute angle $a_1$ with respect to central axis 514 of the center panel 512 of about 15° to about 50°.

Specifically, in one configuration, the step portion 554 extends radially inward from interior wall 520 toward the remainder of the angled inside wall 518, where the radius of curvature $r_4$ is from about 0.006 to about 0.03 inches. Additionally, the step portion 556 extends radially inward from the angled inside wall 518, where the radius of curvature $r_3$ is from about 0.006 to about 0.03 inches. Thus, the angled interior wall 518 can be formed of a surface that includes a pair of curved junctures or step portions with the remainder of the angled interior wall 518 extending linearly and tangentially therebetween; however, it is also possible in an alternative configuration to have a completely arcuate angled inside wall 518 forming a uniform curve or substantially uniform curve.

The annular countersink 522 is formed from the interior wall 520 and an exterior wall 528, which are spaced apart and extend radially outward from a curved bottom portion 524. The inner wall 520 and the outer wall 528 are generally flat and may be parallel to one another and to the central axis 514 but either or both may diverge by an angle of about as much as 15°. Bottom portion 524 preferably has a radius of curvature $r_5$ with positive concavity. Radius of curvature $r_5$ is from about 0.009 to about 0.030 inches. The center panel 512 has a depth $h_2$, measured from the center panel 512 to the lowest point of the curved bottom portion 524, of from about 0.05 to about 0.15 inches, and may vary. The bottom portion 524 of annular countersink 522 may also be formed with different inner and outer radii extending radially outward from a flat portion.

This particular configuration that includes the formation of the angled inside wall 518, step portion 516, and step portion 552 allows for easier bowing or doming of the center panel 512. As can be seen in FIG. 1, conventional or prior art can lids typically utilize a center panel, such as center panel 110 of FIG. 1, that employs a uniform depth $h_1$ (shown in FIG. 5A) of the center panel 512. With center panel 518, as shown according to the present invention, the depth $h_2$ varies as a function of the radial distance from the center axis 514, having a generally negative concave shape. This configuration allows for the reduction in the amount of metal used in the lid. Specifically, the use of a negatively concaved center panel 512 increases the internal volume of a can, which in turn reduces internal pressure, so tension can be decreased so as to reduce the probability of premature or unexpected failure of seams within the can lid 510. Additionally, it is also possible, but not preferable, for the center panel 512 to have a positive concave shape.

In addition to the particular structures employed between the annular countersink 522 and the center panel 512, the outer wall 528 contains a second chuck contacting portion 550 that is one of two points at which the chuck 544 comes in contact with the interior of the can lid 510 during the seaming operation, the other point being the transitional portion 536. An arcuate portion 532 extends radially outward and upward from the outer wall 528. The arcuate portion 532 is shown as having a radius of curvature $r_6$ with negative concavity that is from about 0.100 to about 0.300 inches. The preferred design parameter for radius of curvature $r_6$ is 0.185 inches. The arcuate portion 532 is configured such that a line passing through the innermost end of arcuate portion 532, near the terminus of curved juncture 530, and the outermost end of the arcuate portion 532, near the beginning of step portion 534, forms an acute angle with respect to central axis 514 of the center panel 512. This acute angle is from about 20° to about 80°. The preferred lid design uses an angle of about 50°.

The step portion 534 extends radially outward from the arcuate portion 532. Step portion 534 is preferably curved with a radius of curvature $r_7$ with positive concavity from about 0.02 to about 0.06 inches. The current lid design parameter for radius of curvature $r_7$ is 0.0446 inches.

Figure 6:
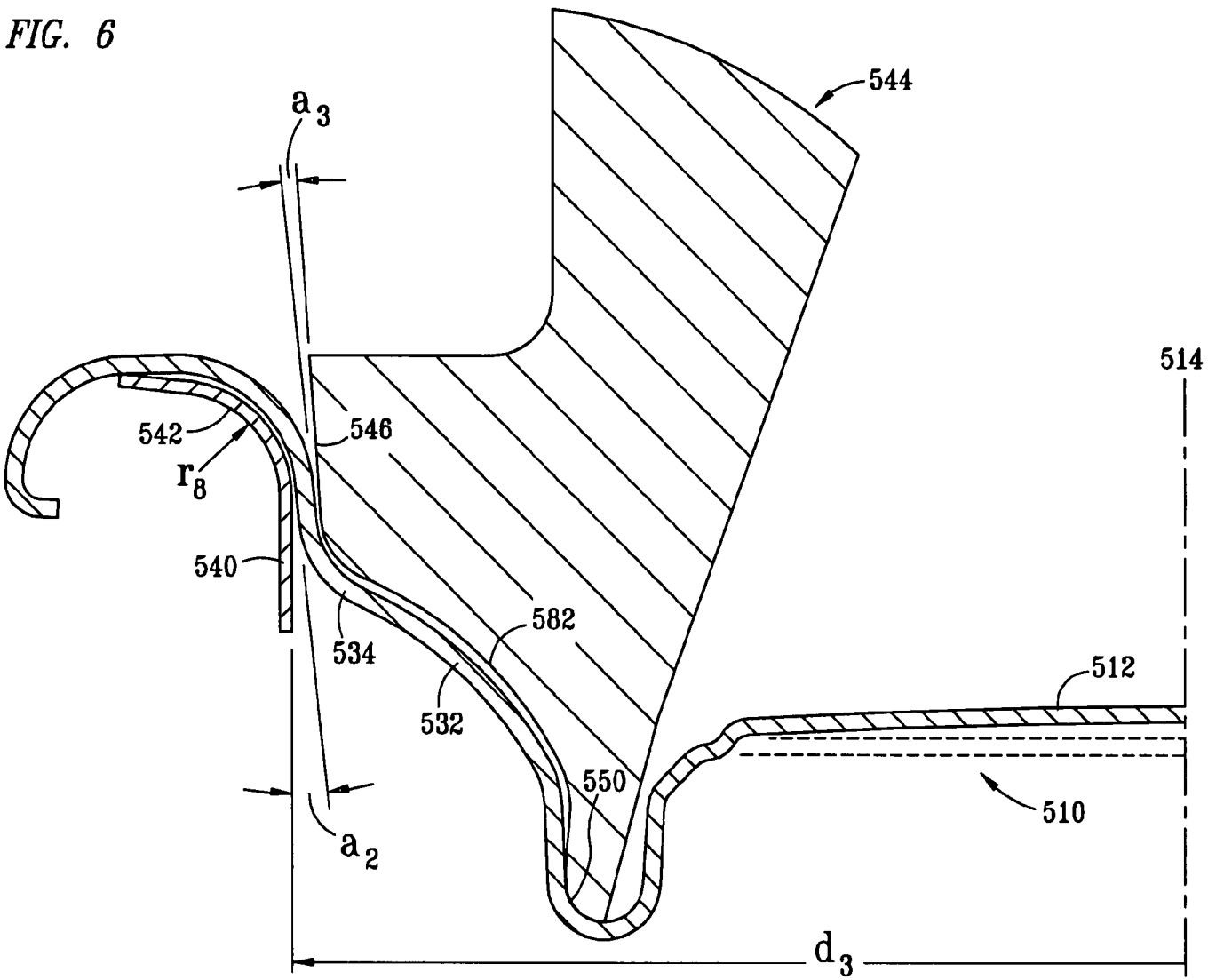
FIG. 6 depicts an elevational cross-sectional view of a portion of a can lid according to FIG. 5 on a can body before the forming of a double seam.

First transitional portion 536 extends radially upward and slightly outward from step portion 534. First transitional portion 536 forms an angle $a_2$ with respect to central axis 514 of the center panel 512. This angle is from about 15° to about 25°. As shown in FIG. 6, angle $a_2$ is intended to be larger than angle $a_3$, which is measured relative to central axis 514. Angle $a_3$ is preferably at least about 2° to aid in removing the can from the chuck 544 after the seaming operation and preferably less than about 8°. The current design parameter for angle $a_3$ is about 4°.

FIG. 6 shows can lid 510 resting on can body 540, and particularly resting on flange 542 of can body 540. The radius $r_8$ of the can flange 542 is slightly smaller than the step portion 537 radius (not shown). Because the flange radius $r_8$ and second transitional portion radius are very similar, the lid easily centralizes on the can for seaming. The can body has an inside neck diameter, a portion of which is indicated by distance $d_3$, from about 2.051 to about 2.065 inches, with a target diameter of about 2.058 inches.

The functional purpose of the chuck 544 in conjunction with can lid 510 is to create a double seam between the can flange 542 and the peripheral curl 538. This is accomplished through the rotation of the chuck 544 so that the peripheral curl 538 can be rolled under the can flange 542 and compressed against the can body 540. Thus, a double seam 554*b*, as shown in FIG. 8, can be formed.

Figure 7:
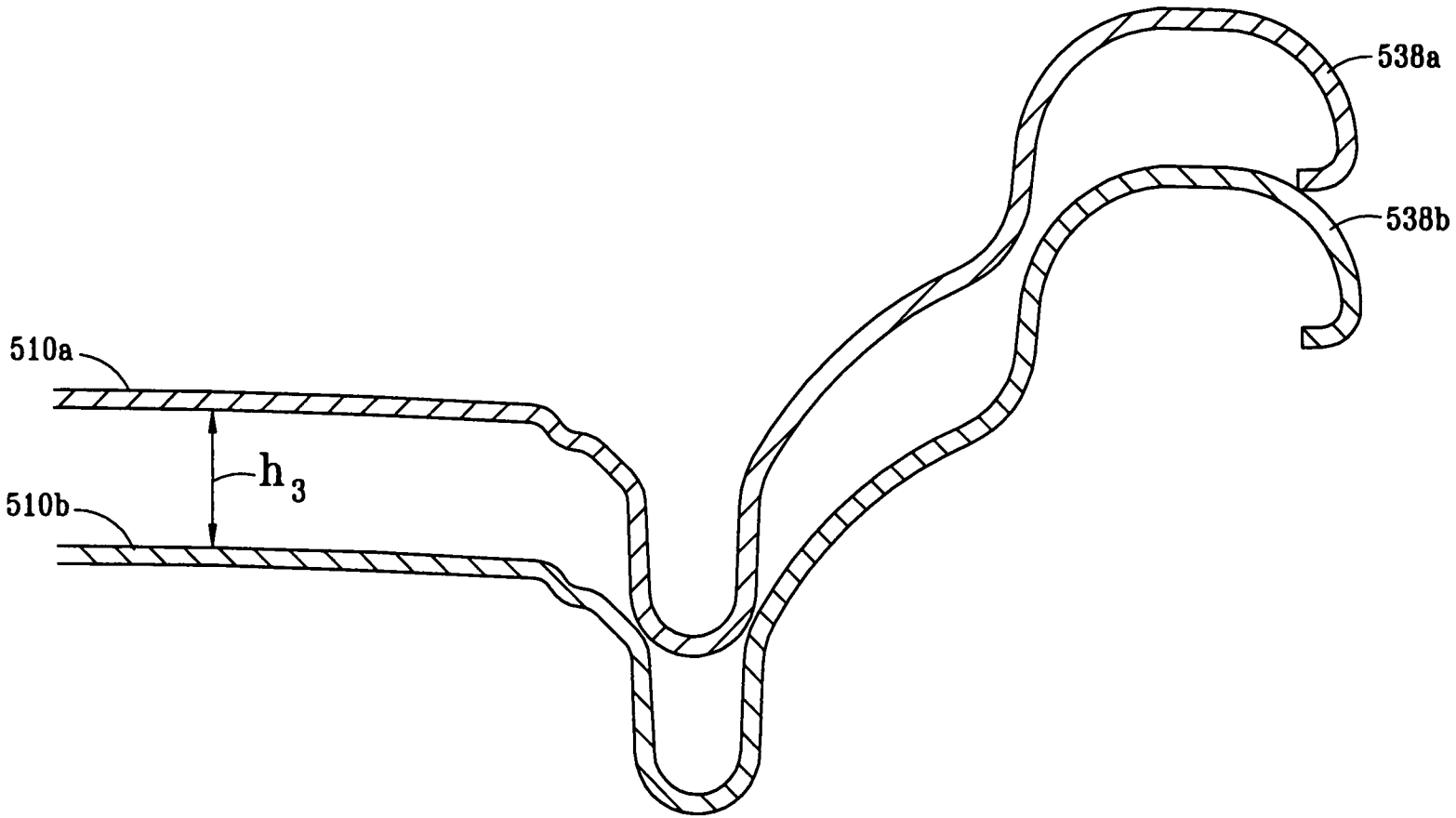
FIG. 7 depicts an elevational cross-sectional view of the manner of stacking can lids of FIG. 5 prior to seaming constructed in accordance with the invention.

FIG. 7 shows the manner in which a plurality of can lids 510*a* and 510*b* stack for handling, packaging, and feeding a seaming machine. Underside of peripheral curl 538*a* bears against upper portion of peripheral curl 538*b* of adjacent can lid 510*b*. Can lid 510*a* is supported and separated from can lid 510*b* by a height $h_3$ sufficient to accommodate the thickness of a pull-tab (not shown). In this manner, can lids 510 are compactly and efficiently handled and are more readily positioned for magazine feeding in a mechanized seaming operation.

Figure 8:
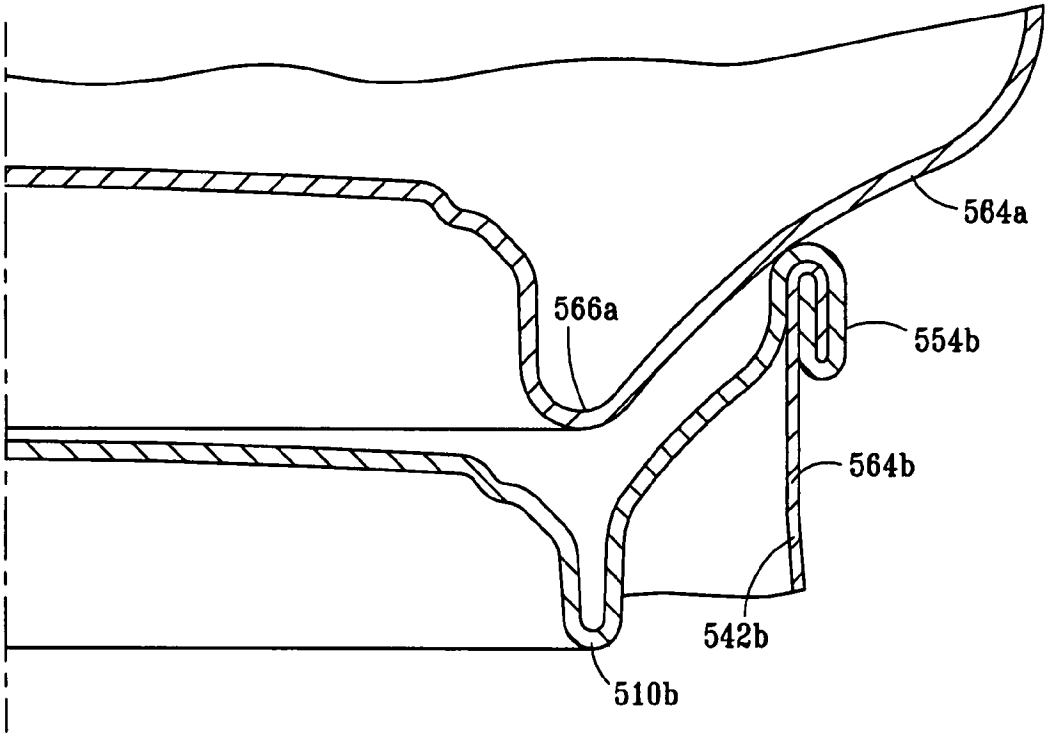
FIG. 8 depicts an elevational cross-sectional view of the manner of stacking filled cans according to FIG. 5 of the present invention.

FIG. 8 shows the manner of stacking filled can 564*a*, closed and sealed according to the present invention on a like filled can 564*b*. Stand bead 566*a* rests upon double seam 554*b*.

Figure 9:
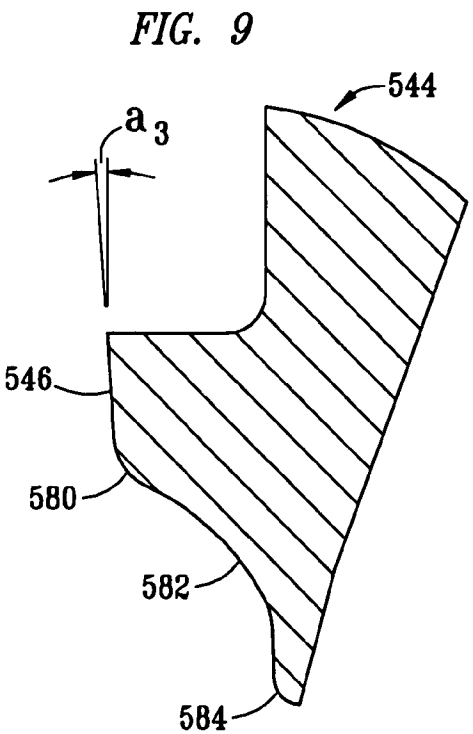
FIG. 9 depicts an elevational cross-sectional view of the chuck used to seam the can lid of FIG. 5 to the can body.

FIG. 9 shows those portions of the chuck 544 shown in FIG. 6, and described above, and also provides a more detailed view of the upper frustoconical portion 546, lower curved portion 580, and the transitional portion 582. Specifically, the upper frustoconical portion 546 and the lower curved portion 580 provide a contact portion for the transitional portion 563 and step portion 534 while the peripheral curl 538 is rolled under the can flange 542 and compressed against the can body 540. Additionally, the transitional portion 582 is designed such that it should not contact the chuck-wall 532 during a seaming operation.

Figure 10:
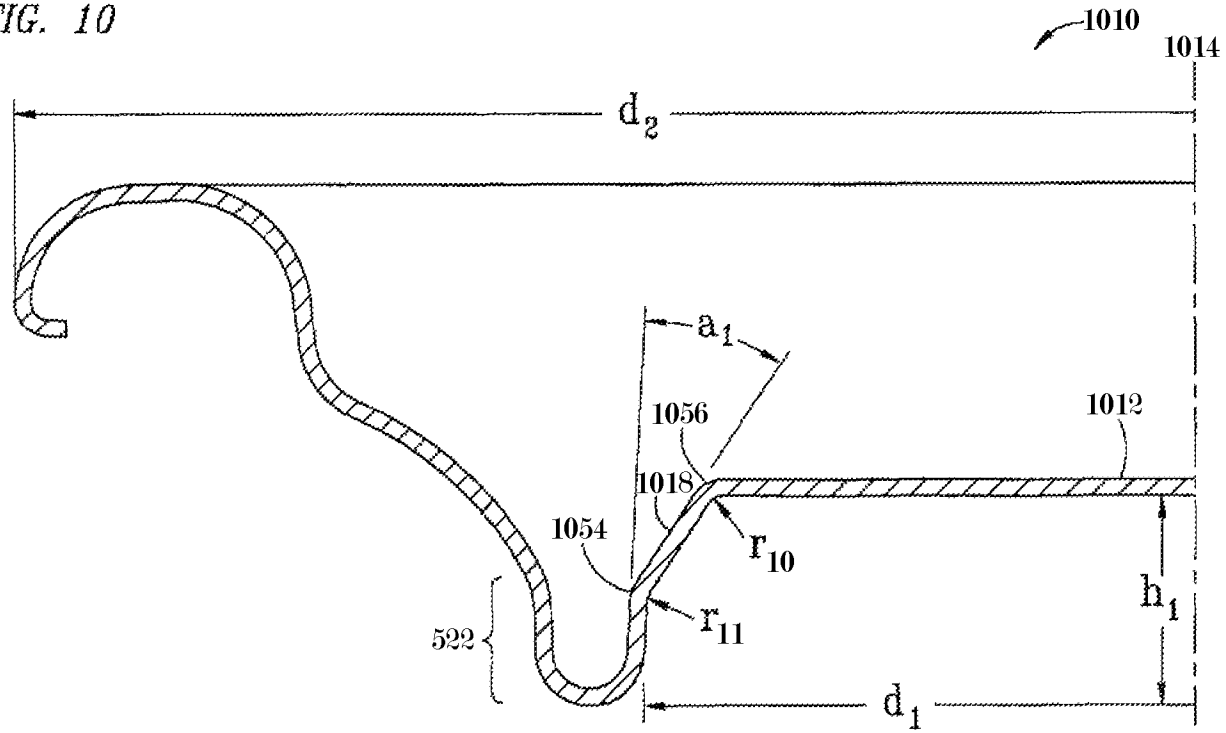
FIG. 10 depicts an elevational cross-sectional view of a second embodiment of the can lid of FIG. 5.

Additionally, there are other configurations that can include an angled inner wall, such as the angled inner wall 518. Referring to FIG. 10 of the drawings, a second embodiment of the present invention of a can lid 1010 employing an angled inner wall 1018 is depicted. This particular embodiment differs from that of FIG. 5 in that there are not multiple structures interposed between angled inner wall 1018 and center panel 1012.

As with FIG. 5, the center panel 1012 is generally circular in shape but may be intentionally noncircular. The center panel 1012 may have a diameter of from about 1.3 to about 2.0 inches, a portion of which is indicated by distance $d_1$. However, in contrast to FIG. 5, the center panel 1012 is shown as having a substantially flat shape with a relatively uniform depth $h_1$; however, it is possible to have a domed or arcuate shape.

Around the outside diameter of the center panel 1010 is step portion 1056 having a radius of curvature $r_{10}$, with a negative concavity that allows transition to a lower depth, which is from about 0.0060 to about 0.015 inches. Step portion 1056, then, is adjacent to angled inside wall 1018. Descending from the bottom of the step portion 1056 is angled inside wall 1018. Angled interior wall 1018 is preferably straight or flat; however, it is possible to have an arcuate wall with a negative or positive concavity. At the end of angled inside wall 1018 is step portion 1054. Step portion 1054 is located between angled inside wall 1018 and countersink 522 (shown in greater detail in FIG. 5), having a radius of curvature $r_{11}$ with negative concavity that is from about 0.0060 to about 0.015 inches. A straight line can, thus, be drawn between the step portion 1056 and the step portion 1054 (or the ends of wall 1018) that forms an acute angle $a_1$ with respect to central axis 1014 of the center panel 1012 of about 15° to about 50°.

With this configuration, there are a variety of advantages over conventional can lids. Specifically, this particular configuration, thus, would allow for a substantial reduction in the amount of metal used in the production of can lid 1010 resulting in a lower cost of production. Additionally, the use of the angled inner wall 1018 would help to decrease tension within the center panel 1012, which increases the structural integrity of the can lid 1010 and which reduces the potential for failure.

The restrictive description and drawings of the specific examples above do not point out what an infringement of this patent would be, but are to provide at least one explanation of how to use and make the invention. The limits of the invention and the bounds of the patent protection are measured by and defined in the following claims.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifi-cations may be considered obvious and desirable by those skilled in the art based upon a review of the foregoing description of preferred embodiments. Accordingly, it is appropriate that the appended claims be construed broadly and in a manner consistent with the scope of the invention.

We claim:

1. A lid for a can body comprising:

a center panel having a central axis that is perpendicular to a diameter of an outer rim of the lid, wherein the center panel has a height that varies as a function of radial distance relative from the central axis;

a first step portion extending radially outward from the center panel, the first step portion having negative concavity and having a radius of curvature less than about 0.015 inches;

a second step portion extending radially outward from the first step portion, the second step portion having a positive concavity and having a radius of curvature less than about 0.015 inches;

an angled inner wall extending radially outward from the second step portion having an angle from a line extending through each end of the angled inner wall relative to the central axis of less than about 50°;

an annular countersink portion extending radially outward from the angled inner wall;

a chuckwall extending radially outward from the annular countersink; and a peripheral curl portion extending radially outward from the chuckwall.

2. The lid of claim 1, wherein the chuckwall further comprises:

an arcuate portion extending radially outward from the annular countersink and characterized by a radius of less than 0.5 inches with a center point below the surface of the lid, wherein a line passing through the ends of the arcuate portion is at an angle with respect to the central axis of the center panel of from about 20° to about 80°;

a third step portion extending radially outward from the arcuate portion and characterized by a radius of at least 0.010 inches, with a center point above the surface of the lid;

a first transitional portion extending radially outward from the third step portion and being generally frustoconical and inclined at an angle with respect to the central axis of at least about 15° and less than about 25°; and a second transitional portion extending radially outward from the first transitional portion and characterized by a radius of at least 0.020 inches with a center point below the surface of the lid.

3. The lid of claim 1, wherein the angled inner wall further comprises a step portion at each end.

4. The can lid according to claim 1 wherein the line passing through the ends of the angled inner wall is at an angle with respect to the central axis of the center panel from about 25° to about 35°.

5. The can lid according to claim 1 wherein a line passing through the ends of the angled inner wall is at an angle with respect to the central axis of the center panel of about 30°.

6. The can lid according to claim 1 wherein the first step portion has a radius of curvature that is about 0.010 inches.

7. The can lid according to claim 1 wherein the second step portion has a radius of curvature that is about 0.010 inches.

8. The can lid according to claim 1 wherein the center panel is substantially domed or arcuate.

9. The can lid according to claim 1 wherein the diameter of the center panel is from about 1.4 to about 2.0 inches.

10. The can lid according to claim 1 wherein the annular countersink has a height of from about 0.030 to about 0.115 inches.

11. A lid for a can body comprising:

a center panel having a central axis that is perpendicular to a diameter of an outer rim of the lid;

a first step portion extending radially outward from the center panel, the first step portion having negative concavity and having a radius of curvature less than about 0.015 inches;

an angled inner wall extending radially outward from the first step portion, the angled inner wall having a pair of ends and extending at an angle such that a line extending through each end of the angled inner wall describes an angle relative to the central axis of less than about 50°;

a second step portion extending radially outward from the angled inner wall, the second step portion having a negative concavity and having a radius of curvature less than about 0.015 inches;

an annular countersink extending radially outward from the second step portion;

a chuckwall extending radially outward from the annular countersink; and a peripheral curl portion extending radially outward from the chuckwall.

12. The lid of claim 11, wherein the chuckwall further comprises:

an arcuate portion extending radially outward from the annular countersink and characterized by a radius of less than 0.5 inches with a center point below the surface of the lid, wherein a line passing through the ends of the arcuate portion is at an angle with respect to the central axis of the center panel from about 20° to about 80°;

a third step portion extending radially outward from the third arcuate portion and characterized by a radius of at least 0.010 inches, with a center point above the surface of the lid;

a first transitional portion extending radially outward from the third step portion and being generally frustoconical and inclined at an angle with respect to the central axis of at least about 15° and less than about 25°; and a second transitional portion extending radially outward from the first transitional portion and characterized by a radius of at least 0.020 inches with a center point below the surface of the lid.

13. The can lid according to claim 11 wherein the line passing through the ends of the angled inner wall is at an angle with respect to the central axis of the center panel from about 25° to about 35°.

14. The can lid according to claim 11 wherein the line passing through the ends of the angled inner wall is at an angle with respect to the central axis of the center panel of about 30°.

15. The can lid according to claim 11 wherein the first step portion has a radius of curvature that is about 0.010 inches.

16. The can lid according to claim 11 wherein the second step portion has a radius of curvature that is about 0.010 inches.

17. The can lid according to claim 11 wherein the center panel is substantially domed or arcuate.

18. The can lid according to claim 11 wherein the diameter of the center panel is from about 1.4 to about 2.0 inches.

19. The can lid according to claim 11 wherein the annular countersink has a height of from about 0.030 to about 0.115 inches.

20. A lid for a can body comprising:

a center panel having a central axis that is perpendicular to a diameter of an outer rim of the lid;

a step extending radially outwardly from the center panel, the step having a first portion extending radially outward from the center panel and having negative concavity and a second portion extending radially outward from the first portion and having a positive concavity;

an angled inner wall extending radially outward from the step and extending at an angle such that a line extending through each end of the angled inner wall described an angle relative to the central axis of less than about 50°;

an annular countersink portion extending radially outward from the angled inner wall;

a chuckwall extending radially outward from the annular countersink; and a peripheral curl portion extending radially outward from the chuckwall.

21. The lid of claim 20, wherein the chuckwall further comprises:

an arcuate portion extending radially outward from the annular countersink and characterized by a radius of less than 0.5 inches with a center point below the surface of the lid, wherein a line passing through the ends of the arcuate portion describes an angle relative to the central axis of the center panel of from about 20° to about 80°;

a third step portion extending radially outward from the arcuate portion and characterized by a radius of at least 0.010 inches, with a center point above the surface of the lid;

a first transitional portion extending radially outward from the third step portion and being generally frustoconical and inclined at an angle with respect to the central axis of at least about 15° and less than about 25°; and a second transitional portion extending radially outward from the first transitional portion and characterized by a radius of at least 0.020 inches with a center point below the surface of the lid.

22. The lid of claim 20, wherein the angled inner wall further comprises a radius at each end.

23. The lid of claim 20, wherein the line passing through the ends of the angled inner wall describes an angle relative to the central axis of the center panel from about 25° to about 35°.

24. The lid of claim 20, wherein the line passing through the ends of the angled inner wall describes an angle relative to the central axis of the center panel of about 30°.

25. The lid of claim 20, wherein the first portion of the step has a radius of curvature that is about 0.010 inches.

26. The lid of claim 20, wherein the second portion of the step has a radius of curvature that is about 0.010 inches.

27. The lid of claim 20, wherein the center panel is substantially domed or arcuate.

28. The lid of claim 20, wherein the diameter of the center panel is from about 1.4 to about 2.0 inches.

29. The lid of claim 20, wherein the annular countersink has a height of from about 0.030 to about 0.115 inches.

* * * * *